United States Patent [19]

Bryans et al.

[11] Patent Number: 4,521,783

[45] Date of Patent: Jun. 4, 1985

[54] OFFSET MICROWAVE FEED HORN FOR PRODUCING FOCUSED BEAM HAVING REDUCED SIDELOBE RADIATION

[75] Inventors: Lawrence G. Bryans, Mountain View; Kenneth R. Goudey, Sunnyvale; William F. Nickerson, San Francisco, all of Calif.

[73] Assignee: Ford Aerospace & Communications Corporation, Detroit, Mich.

[21] Appl. No.: 424,946

[22] Filed: Sep. 27, 1982

[51] Int. Cl.[3] ..... H01Q 19/13

[52] U.S. Cl. ..... 343/781 R; 343/781 P; 343/781 CA; 343/786

[58] Field of Search ..... 343/781 R, 781 P, 781 CA, 343/786

[56] References Cited

U.S. PATENT DOCUMENTS

| | | |
|---|---|---|
| 2,912,695 | 11/1959 | Cutler . |
| 3,212,096 | 10/1965 | Schuster et al. . |
| 3,618,106 | 11/1969 | Bryant . |
| 3,732,531 | 11/1971 | Neale . |
| 3,924,237 | 12/1975 | Fletcher et al. . |
| 3,936,837 | 2/1976 | Coleman et al. . |
| 4,168,504 | 9/1979 | Davis . |

FOREIGN PATENT DOCUMENTS

| | | |
|---|---|---|
| 2342904 | 4/1975 | Fed. Rep. of Germany ..... 343/781 CA |
| 2715796 | 10/1978 | Fed. Rep. of Germany ..... 343/781 CA |

*Primary Examiner*—Eli Lieberman
*Assistant Examiner*—Karl Ohralik
*Attorney, Agent, or Firm*—Edward J. Radlo; Robert D. Sanborn; Robert K. Stoddard

[57] ABSTRACT

A short-focus microwave reflector is located a short distance away from the feed horn and is positioned to reflect the beam of microwave radiation away from the feed axis and toward a large primary reflector antenna for transmission. A conical shield extends from the feed horn to the secondary reflector, joining them together as a unit and preventing sidelobe radiation. The beam of radiation emerges from the shield through an aperture in the sidewall thereof. The short focus of the secondary reflector causes the beam to be focussed approximately at the plane of the aperture, such that the beam diameter is small and the aperture can also be small, reducing stray radiation from the shield structure. Diffraction at the edges of the aperture is reduced by a radially surrounding choke structure which further suppresses sidelobe radiation.

10 Claims, 5 Drawing Figures

OFFSET MICROWAVE FEED HORN FOR PRODUCING FOCUSED BEAM HAVING REDUCED SIDELOBE RADIATION

BACKGROUND OF THE INVENTION

This invention relates generally to the field of microwave antennas for transmitting and receiving signals in the spectrum of microwave electromagnetic radiation. More particularly, the invention relates to an offset feed horn for propagating energy toward and receiving energy from a microwave reflector antenna for use especially in satellite-ground communication systems.

Such communication systems have come into widespread use for a variety of military and commercial communications purposes, including the transmission of commercial television signals over long distances, the transmission of telemetry data from space stations and the surveillance and reporting of events on Earth.

With the growth in use of such communication systems has come a corresponding increase in the difficulty of avoiding interference between simultaneous transmissions. Since the number of frequency channels is limited, the need to impose very strict limits on the transmitted beam width has required increasing sophistication in the design of the antennas used.

With improved control of the width and shape of the beams employed the simultaneous use of a single channel by several different communication systems transmitting between geographically separate points becomes possible. In order for such simultaneous use to be practical, however, the antenna designs must severely limit the quantity of microwave radiation which is directed into sidelobes propagating along axes which diverge from the main propagation axis.

The geometries of antenna designs in use for such communication systems are generally modeled after reflecting optical telescope designs such as the Newtonian, Gregorian and Cassegrainian systems. Consequently, most employ single or multiple-arrayed microwave feed horns as the source (in transmission mode) of microwave radiations. The energy propagating from this source is then focused into a more-or-less diverging beam directed toward the receiver or the receiving zone on Earth in the case of satellite-to-ground communications.

By careful optical design, the size and shape of the beam and the signal intensity profile across the extent of the beam can be quite well controlled. The same design procedure can also be employed to control the size and location of sidelobe radiation resulting from residual aberrations in the design of the optical system.

However, an important source of sidelobe radiation derives from spillover within the antenna system itself. Such spillover occurs because the microwave feed horn fails to direct all of its radiation along axes which will intercept the large main reflective antenna. Since spillover radiation avoids the reflective antenna, it cannot be focussed into the main propagating beam and becomes instead a source of unwanted interfering radiation in geographical areas outside the intended transmission zone.

Consequently, an important source of unwanted interfering or sidelobe radiation present in existing antenna designs could be eliminated by preventing the propagation of radiation from the feed horn assembly to the main reflective antenna along axes which do not intersect the surface of the reflective antenna.

DESCRIPTION OF THE PRIOR ART

U.S. Pat. No. 2,912,695 issued Nov. 10, 1959 to C. C. Cutler—The Cutler patent deals generally with the use of corrugated conductive surfaces in wave propagating structures and particularly with the use of such surfaces to control phase delay, achieve filtering and provide mode suppression in propagating waves. However, there is no indication of how such corrugated surfaces could be used to overcome the spillover problems addressed by the present invention.

U.S. Pat. No. 3,212,096 issued Oct. 12, 1965 to D. M. Schuster et al—The Schuster patent illustrates and describes the use of a relatively large flat ground plane concentrically surrounding the mouth of a simple feed horn and at right angle to the axis of propagation from the horn to the main reflective antenna located on the surface of the Earth below. Around the periphery of the ground plane are a plurality of concentric ridges. The ground plane together with its ridges serve as a means to limit the transmission or acceptance angle of the feed horn by preventing the surface currents needed to excite a plane wave in the region of space next to the ground plane, as disclosed at col. 3, 11.30-34 of the patent.

U.S. Pat. No. 3,618,106 issued Nov. 10, 1969 to G. H. Bryant—Bryant teaches the use of corrugated waveguide to form antenna feed horns. The corrugations extend throughout the length of the horn, and both the cross-sectional dimensions of the horn and the height of the corrugations are tapered to achieve broad bandwidth and good impedance match at each end of the horn.

U.S. Pat. No. 3,732,531 issued Nov. 5, 1971 to N. W. T. Neale—The Neale patent illustrates a microwave antenna in the form of a conical horn having a plurality of ridges on the inner surface of the horn for the suppression of off axis radiation and frequency-dependent distortions. The principal novelty of the patent lies in the arrangement of the ridges in spiral or helical form for ease of manufacture.

U. S. Pat. 3,924,237 issued Dec. 2, 1975 to Fletcher et al—The Fletcher patent details a rectangular tapered horn in which the broad walls are provided with vee-shaped corrugations to minimize sidelobe radiation and improve bandwidth while being relatively easy to manufacture.

U.S. Pat. No. 3,936,837 issued Feb. 3, 1976 to Coleman et al—Coleman utilizes an offset shielded feed horn to irradiate a parabolic reflector, which focuses and redirects the radiation of the feed horn into a beam propagating along an axis displaced from the feed axis. The conical feed horn is provided with corrugations on its interior surface for suppression of sidelobe radiation.

U.S. Pat. No. 4,168,504 issued Sept. 18, 1979 to Davis—Davis uses an offset feed design which employs three concentric rings around the aperture of beam propagation. Although these rings resemble the corrugations employed as distributed inductance or capacitance in waveguides, they are used by Davis as resonant tuning structures to maximize the focal plane capture area.

SUMMARY OF THE INVENTION

The present invention employs a shielded offset feed horn in which radiation emanating from a conical feed horn impinges on a secondary elliptical reflector which focuses the radiation into a beam and redirects it through an aperture barely larger than the beam cross section toward a primary reflector for transmission as a propagating beam consisting of parallel rays.

Spillover of the radiation from the conical horn is prevented by a conical shield structure extending from the feed horn at one end thereof to the secondary reflector or at the other end. The interior surfaces of both the feed horn and the conical shield structure are desirably corrugated to aid in the suppression of undesirable sidelobe radiation.

The focused radiation emerges from the shield structure to propagate toward the primary reflector through the above-mentioned aperture in the sidewall of the shield. By selection of a relatively short focal length for the elliptical reflector, the beam can be of relatively small diameter at the point of emergence through the aperture in the shield structure, requiring only a relatively small aperture. Consequently, the amount of stray radiation attributable to the unshielded area of the aperture is very small.

According to a further feature of the invention sidelobe radiation can be further suppressed by substantially reducing the contribution to this radiation from diffraction at the edges of the aperture. Such diffraction is a natural consequence of the finite size of the aperture and its proximity to the edges of the beam.

However such diffraction can be effectively suppressed and prevented from creating a source of sidelobe radiation by the use of an approximately radially symmetric surface shaped and formed to provide a surface reactance concentrically surrounding the aperture for substantially reducing the radial surface currents which are associated with the beam diffraction at the aperture edges.

The above and other features, objects and advantages of the present invention together with the best mode contemplated by the inventors thereof for carrying out their invention will become more apparent from reading the following detailed description of a preferred embodiment of the invention while studying the associated drawing, the various figures of which represent:

DETAILED DESCRIPTION OF A PREFERRED EMBODIMENT

Figure 1:
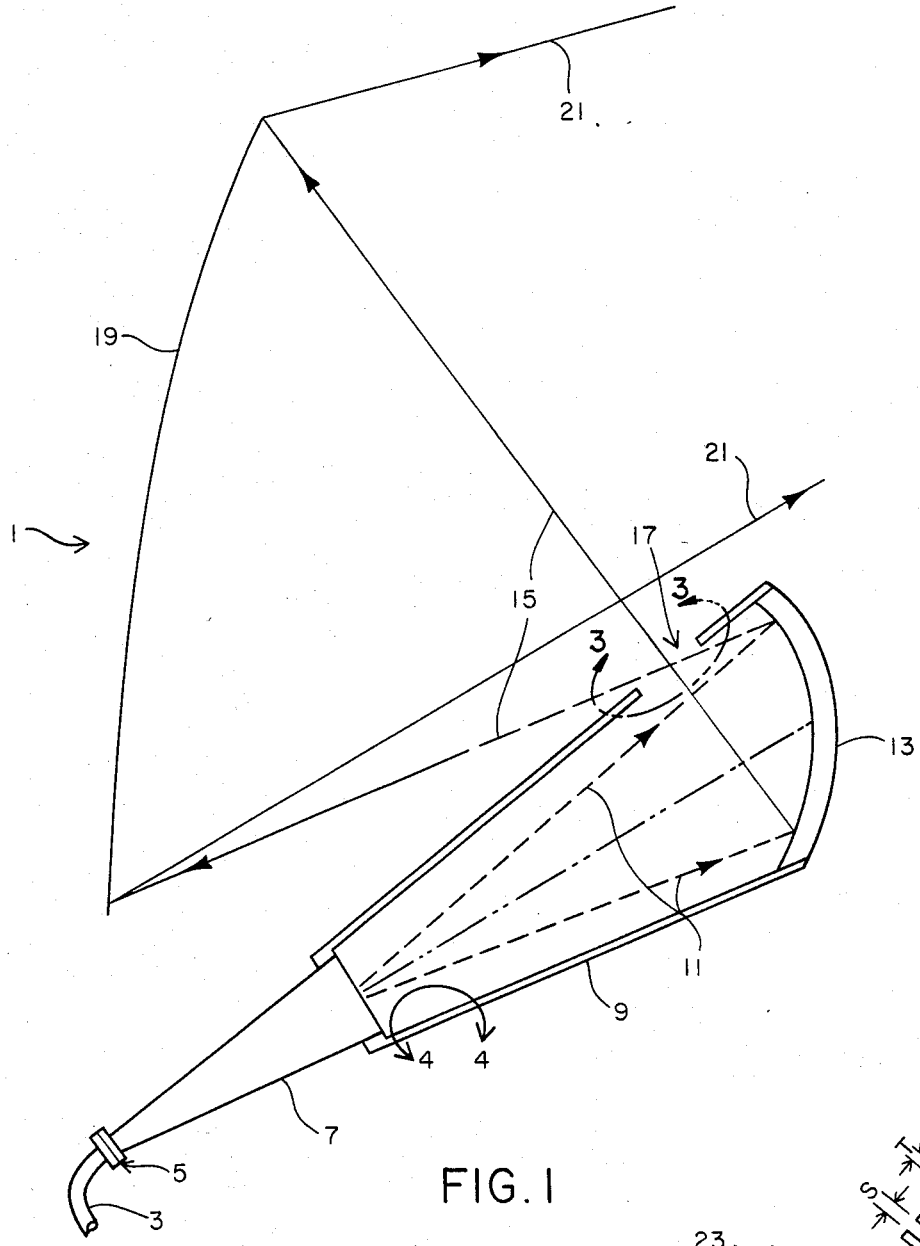
FIG. 1 is a side view partially in elevation and partially in section of an embodiment of the invention.

In FIG. 1, a microwave antenna system 1 according to the present invention is shown in a partially schematic form which reveals the optical geometry. Antenna system 1 would be connected to a microwave transmitting and receiving apparatus (not shown) by means of a conductor 3, which would typically be a waveguide or coaxial line. The system is representative of either a satellite station or ground station in a microwave satellite communications system.

Conductor 3 is joined by means of a flanged connector 5 to one end of a conical feed horn 7 of conventional design. The other end of feed horn 7 is joined to a conical shield 9, for example by being brazed thereto along the adjoining edges of these two parts. Shield 9 serves within the context of the present invention as a means for limiting and defining the edge of the beam of microwave radiation from feed horn 7.

Within the enclosed space defined by shield 9, a relatively broad beam of microwave radiation propagates from feed horn 7 along arrows 11, which define the shape of the beam, to strike a curvilinear microwave reflector 13 which spans and closes the end of shield 9.

Reflector 13 serves to redirect and focus the beam of microwave radiation impinging on it from feed horn 7 and causes this beam to be shaped and directed as illustrated by arrows 15 in FIG. 1. Reflector 13 is relatively steeply curved, has a correspondingly short focal length; and may have a shape which is hyperboloidal, ellipsoidal, or other desired shape depending upon necessary optical corrections which may be incorporated into reflector 13 in its design.

The focused and redirected beam defined by arrows 15 is steeply convergent as shown in FIG. 1, and comes to a focus very nearly at the location of an aperture 17 in the sidewall of shield 9. By converging the beam so abruptly, aperture 17 can be made relatively small in diameter without danger of intercepting any portion of the beam. Consequently, relatively little scattered or unfocused microwave energy can escape from shield 9.

Passing through aperture 17, the now rapidly diverging beam defined by arrows 15 strikes a nearby main reflector antenna 19, which may be of paraboloidal, hyperboloidal, or some other complex solid shape. As in the case of reflector 13, the exact shape of antenna 19 would be selected in view of the need to minimize aberrations and otherwise optimize the optical performance of the entire system for its intended use.

Antenna 19 has been shown schematically as a curved line which merely illustrates the shape of its curved reflective surface in cross section. However in practice the antenna might be formed of spun sheet metal such as aluminum, might be closely spaced network such as a conductive mesh, might be formed as a collapsible network of conductive strips when designed for use on a satellite spacecraft, or might be made up of several smaller panels positioned so as to closely approximate the desired curved shape.

Arrows 21 illustrate the shape and extent of the final propagating beam of radiation as it emerges from the system 1 to propagate toward a receiver or receiving area which might be 20,000 or more miles away. As shown, the beam is nearly parallel but slightly converging. In practice, such a beam might be diverging or converging, depending on the nature of the system and its intended use.

The apparatus of FIG. 1 as thus far described is relatively compact and provides an exceptionally high degree of discrimination against "spillover" or scattered and unfocused microwave radiation from the feed horn and subreflector. To a large extent, these characteristics are due to the use of a continuous conductive shield extending fully from the feed horn 7 to the reflector 13 and to the provision for very rapid convergence of the beam by reflector 13 such that aperture 17 can be as small as possible.

However, the small diameter of aperture 17 also has an unfortunate negative consequence in a system designed to substantially eliminate sidelobes of microwave radiation outside the desired transmission area. The relative proximity of the beam edges to the aperture has been found to lead to diffraction and to the production of another source of scattered and unfocused microwave radiation in the region near the aperture with the result that sidelobe amplitude was not reduced as significantly as had been hoped.

Figure 2:
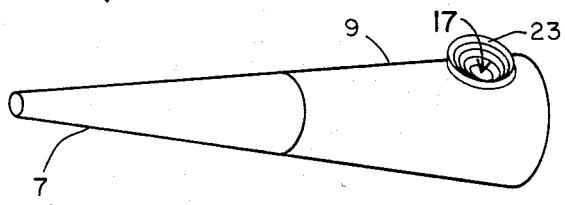
FIG. 2 is a view in elevation of an offset feed according to the present invention.
Figure 3:
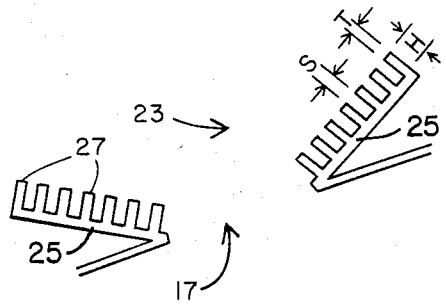
FIG. 3 is a side sectional view of the portion of FIG. 1 within the arrows 3—3.

Turning now to FIG. 2 and 3 and in accordance with the present invention, these diffraction effects can be significantly reduced or eliminated by the incorporation of a novel form of diffraction suppressor 23 in a position surrounding the aperture 17. Suppressor 23, which is shown in elevation in FIG. 2 and in more detailed section in FIG. 3, serves as a means to cut off the surface currents associated with the diffraction phenomenon by increasing the reactance of the surface region of shield 9 surrounding aperture 17.

In particular, the surface of suppressor 23 presents a greatly increased reactance to electric current flowing radially toward or away from aperture 17. Consequently, these current are reduced and so are the unwanted microwave radiations which they induce. As a result, the sidelobe radiation which would have resulted from this source of unfocused radiation is reduced or eliminated.

In FIGS. 2 and 3, suppressor 23 is shown as it appears when mounted on shield 9 and in detailed cross section. As shown in these figures, suppressor 23 includes a truncated conical base portion 25 which is mounted to, or forms an integral part of shield 9. In practice, shield 9 might be formed of silver-plated brass or other conductive material, and suppressor 23 might be of identical material, the two being joined together prior to plating.

From the inner conical surface of suppressor 23 project a plurality of concentric spaced ridges 27. Each of these ridges joins base portion 25 at approximately a right angle thereto, such that each ridge is actually a very short truncated section of a cone, as will be apparent from considering FIGS. 2 and 3 together.

As noted earlier in this application, ridges 27 together form a surface reactance which strongly attenuates the radical currents in the region of aperture 17. For this purpose, each of these ridges has a height H in FIG. 3 which is less than $\frac{1}{4}$ the free-space wavelength of the microwave energy involved. Both the thickness T and inter-ridge spacing S may be less than 1/8 wavelength.

Figures 4, 5:
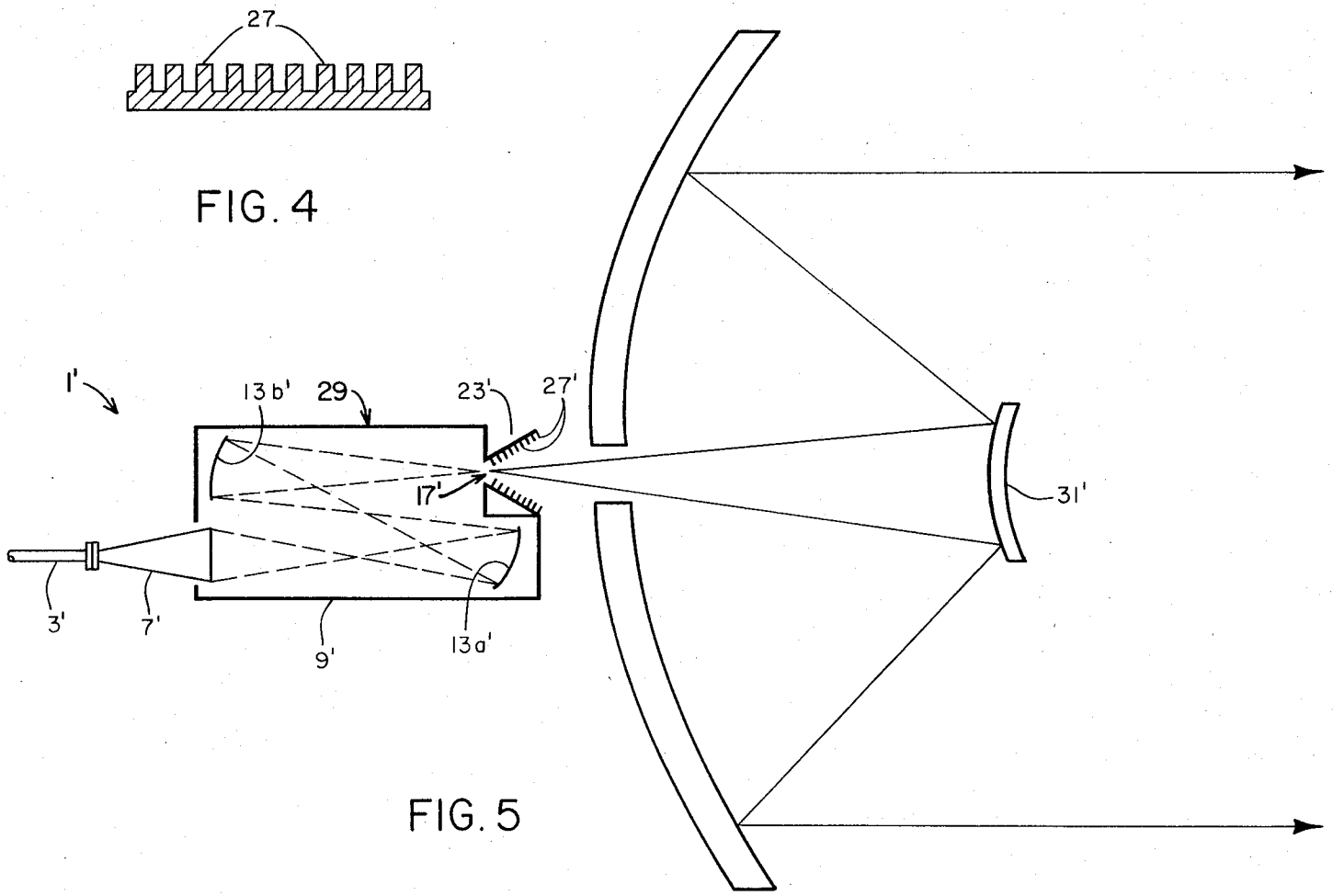
FIG. 4 is a detailed sectional view of the portion of FIG. 1 within the arrows 4—4.
FIG. 5 is a side sectional view of an alternate embodiment of the present invention.

FIG. 4 illustrates a portion of the side-wall of shield 9, and shows that a plurality of spaced ridges 27' are desirably provided along the inner surface of shield 9 for further suppressing sidelobe radiation. Similarly, such ridges may desirably be provided on the interior surface of horn 7, and may be arranged and dimensioned similarly to the ridges 27 of FIG. 3.

In FIG. 5 an alternative embodiment of the present invention is illustrated with primed reference numerals used to indicate parts of the apparatus which correspond to FIG. 1. In FIG. 5 a folded inline antenna feed apparatus 29 has been shown incorporated in a microwave antenna system 1' of Cassegrainian configuration. Feed apparatus includes a shielding enclosure 9' in the shape of an elongated box, into one end of which a conventional feed horn 7' projects.

As in the case of FIG. 1, feed horn 7' is provided with a conductor 3' for connection to the microwave receiver and/or transmitter. Within enclosure 9', the diverging beam of microwave radiation from feed horn 7' strikes a first reflector **13*a'*** and is redirected and caused to converge by this reflector.

However, unlike the arrangement of FIG. 1, the beam next strikes a second reflector **13*b'* which further converges and redirects the beam toward an aperture 17'. Reflectors 13*a'* and 13*b'*** may be identical in shape or may preferably be individually designed such that different aberrations in the optical system may be corrected by each.

In either case, reflectors **13*a'* and 13*b'* may in general have less curvature than is used in the case of the singly convergent reflector 13 in FIG. 1. Moreover, the beam of radiation emerging through the aperture 17' in FIG. 5 is obviously less rapidly diverging than was true in the case of FIG. 1**.

Consequently, incorporation of this type of feed in a Cassegrainian or Gregorian antenna system does not require the use of an excessively large secondary reflector 31 as would be the case with the feed arrangement of FIG. 1. However, the optical geometry illustrated with the feed arrangements of either FIG. 1 or FIG. 5 could be altered, and any known optical geometries could be used as well.

As in the case of FIG. 1, a diffraction suppressor 23' is incorporated surrounding the aperture 17' in FIG. 5. As before, suppressor 23' is formed as a truncated section of a cone, although the moderate angle of divergence characteristic of the folded feed horn of FIG. 5 makes a smaller cone angle practical. A plurality of ridges 27' dimensioned and spaced as in FIG. 1 serve to locally increase the surface inductance about the mouth of aperture 17', effectively suppressing radial currents and the interfering modes they support.

Although this invention has been described with some particularity with respect to several embodiments which, taken together, comprise the best mode known to the inventors for carrying out their invention, many modifications could be made and many alternative embodiments could thus be derived without departing from the scope of the invention. Consequently, the scope of the invention is to be determined only from the following claims.

We claim:

1. An apparatus for producing a focused beam of high-frequency electromagnetic radiation propagating along an axis, comprising in combination:

an electromagnetic horn radiator for producing in response to an input source of electromagnetic energy a first relatively broad beam of electromagnetic radiation propagating away from said horn radiator along a first axis;

a curvilinear electromagnetic reflector located spaced from said horn radiator along said first axis, said reflector being dimensioned and positioned to intercept said relatively broad beam of radiation;

beam-edge defining means extending between said horn radiator and said reflector for limiting and confining said first beam and for preventing the propagation of energy along paths outside the outer edges of said reflector;

said beam-edge defining means being provided with an aperture therethrough in a wall portion thereof between said horn and reflector;

said reflector being shaped and positioned to redirect radiation propagating along said first axis into a sharply defined beam propagating along a second axis extending from said reflector to said aperture, and to bring said radiation to a focus in the region of said aperture.

2. The apparatus of claim 1 further comprising diffraction-suppression means surrounding said aperture for suppressing diffraction of said sharply defined beam to thereby prevent formation of secondary beams propagating along axes at an angle to said second axis.

3. The apparatus of claim 2 wherein said diffraction-suppression means comprises a means for increasing the reactance of surface regions of said beam-edge defining means adjacent said aperture, whereby spurious interfering resonant modes of electromagnetic energy in the region of said aperture are suppressed.

4. The apparatus of claim 3 wherein said diffraction-suppression means increases the surface inductance of said beam-edge defining means in the region thereof surrounding said aperture.

5. The apparatus of claim 4 wherein said means for increasing inductance comprises an approximately radially symmetric choke surrounding said aperture.

6. The apparatus of claim 5 wherein said choke comprises a truncated cone defining a smaller opening at one end thereof and a larger opening at the other end thereof, said choke being mounted to said beam-edge defining means with said smaller opening concentric with and adjacent to said aperture.

7. The apparatus of claim 4 wherein said means for increasing inductance comprises means for increasing the surface rugosity of said beam-edge defining means along paths extending radially outwardly from said aperture.

8. The apparatus of claim 7 wherein said means for increasing surface rugosity comprises a plurality of discrete surface ridges concentrically surrounding said aperture.

9. The apparatus of claim 6 wherein said choke further includes a plurality of spaced, concentric ridges projecting inwardly from the inner surface thereof.

10. The apparatus of claim 9 wherein said ridges are spaced apart by less than $\frac{1}{4}$ of the wavelength of the electromagnetic radiation.

* * * * *